US005333761A

United States Patent [19]

Davis et al.

[11] Patent Number: 5,333,761

[45] Date of Patent: Aug. 2, 1994

[54] COLLAPSIBLE BOTTLE

[75] Inventors: Richard C. Davis, Palm Harbor, Fla.; Terrance L. Domin, Crystal Lake, Ill.

[73] Assignee: Ballard Medical Products, Draper, Utah

[21] Appl. No.: 852,004

[22] Filed: Mar. 16, 1992

[51] Int. Cl.[5] ..... B65D 37/00

[52] U.S. Cl. ..... 222/212; 222/215

[58] Field of Search ..... 222/92, 210, 212, 215, 222/107; 604/216

[56] References Cited

U.S. PATENT DOCUMENTS

| | | | |
|---|---|---|---|
| 1,663,665 | 3/1928 | Loomis | 222/092 X |
| 1,751,341 | 3/1930 | Leisse | 222/092 |
| 2,268,993 | 1/1942 | Sanders | 221/60 |
| 2,649,995 | 8/1953 | Muskin | 222/092 |
| 2,899,110 | 8/1959 | Parker | 222/215 |
| 2,911,972 | 11/1959 | Elinger | 128/216 |
| 3,012,695 | 12/1961 | Lerner | 222/129 |
| 3,143,429 | 8/1964 | Swanson et al. | 222/215 X |
| 3,174,655 | 3/1965 | Hurschman | 222/215 |
| 3,340,869 | 9/1967 | Bane | 128/2 |
| 3,390,821 | 7/1968 | Mullan | 222/215 X |
| 3,506,163 | 4/1970 | Rauh et al. | 222/212 |
| 3,618,846 | 11/1971 | Poli | 228/52 |
| 3,651,990 | 3/1972 | Cernei | 222/94 |
| 3,833,154 | 9/1974 | Markovitz | 222/212 |
| 3,875,941 | 4/1975 | Adair | 222/210 X |
| 3,938,514 | 2/1976 | Boucher | 128/232 |
| 4,024,992 | 5/1977 | Schmid | 222/211 |
| 4,327,782 | 5/1982 | McKibben et al. | 141/26 |
| 4,349,129 | 9/1982 | Amneus | 221/41 |
| 4,411,656 | 10/1983 | Cornett, III | 604/212 |
| 4,516,697 | 5/1985 | Dreps et al. | 222/212 |
| 4,596,343 | 6/1986 | Ford, Jr. | 222/190 |
| 4,640,440 | 2/1987 | Ford, Jr. et al. | 222/190 |
| 4,753,638 | 6/1988 | Peters | 604/212 |
| 4,773,458 | 9/1986 | Touzani | 150/55 |
| 5,178,300 | 1/1993 | Havir et al. | 222/212 X |

*Primary Examiner*—Karen B. Merritt
*Assistant Examiner*—Kenneth Bomberg
*Attorney, Agent, or Firm*—Lynn G. Foster

[57] ABSTRACT

A collapsible container (10) comprises a collapsible housing (12) having a nozzle (14) at a nozzle end (16), a base (18) at an opposite base end (20), and a collapsible sidewall (22) interconnecting the nozzle and the base. The collapsible housing defines interconnecting elements (44) for coupling the base to the sidewall for allowing the base to evert and invert, the base having a shape and size substantially corresponding to that of a collapsed interior space (26) of the collapsible container when it is collapsed. The interconnecting elements are positioned approximately at a minimum non-expanded laterally-outward position (32) of the sidewall, and the wall (34) of the base element at the interconnection elements extends almost parallel to an axis of elongation of the collapsible container. The base includes an inwardly-directed protrusion (38) thereon having dimensions corresponding to a nozzle interior space (28) and being positioned to be inserted into the nozzle from the interior of the container when the container is fully collapsed. A one-way valve nozzle device (64) can be positioned at the nozzle.

9 Claims, 3 Drawing Sheets

COLLAPSIBLE BOTTLE

BACKGROUND OF THE INVENTION

This invention relates generally to the art of collapsible containers and more specifically to collapsible containers for medical use or for use as dispensers of other types of material.

Although the volume of packaging is important for most containers, it is especially crucial for containers of drugs, or other medicinal materials which are often delivered in containers housing specific dosages. When a container houses a specific dosage, it is important that substantially the entire amount of material be ejected from the container so that one can be sure that a proper dosage has been administered. Also, many materials, especially medicines are expensive; thus, it is important that as much medicine as possible is ejected from a container to avoid waste and undue expense.

U.S. Pat. No. 3,506,163 to Rauh et al describes a collapsible container having a protuberance extending inwardly from a bottom end thereof for being inserted into a neck of the container when it is collapsed to displace material from the neck. Although the Rauh et al device has some advantages, it is disadvantageous in that the protuberance takes up interior space of the container. Thus, it is an object of this invention to provide a collapsible container which can be collapsed to eject substantially all of the materials in a container, but yet which does not unduly limit the interior space thereof.

Another difficulty with the device of U.S. Pat. No. 3,506,163 to Rauh et al is that although the protuberance appears to fit into an interior space of the neck, it does not especially eject material positioned between the protuberance and bellows portions of the container. Thus, it is also an object of this invention to provide a collapsible container which, when it is fully collapsed, ejects substantially all material from an interior space of the container.

A difficulty with most prior-art collapsible containers not constructed of malleable material is that they tend to "spring-back" into their pre-collapsed configurations due to an "elastic memory" of sidewalls thereof. Not only does this "springing back" make it difficult to fully empty such a container, but it also causes backwashing, or sucking of ejected material back into the container and the sucking of air, or other proximate debris which may contaminate undispensed material in the container. Thus, it is an object of this invention to provide a collapsible container not constructed of a malleable material which can steadily dispense contained material in incremental amounts while progressively emptying and collapsing without the container springing back.

It is a further object of this invention to provide a collapsible container fulfilling the objects mentioned above which is relatively inexpensive to construct and easy to use.

SUMMARY OF THE INVENTION

According to principles of this invention, a collapsible container has a collapsible housing including a nozzle at a nozzle end thereof and a base at a base end thereof interconnected by a collapsible sidewall which collapses and expands to allow the base to move toward and away from the nozzle. The housing includes interconnections for coupling the base to the sidewall which allow the base to protrude outwardly, thereby significantly increasing the volume of the interior space of the collapsible container, and which also allow the base to protrude inwardly, into the interior space of the collapsible container, thereby decreasing the volume of the interior space. The base has a shape and size substantially corresponding to an interior space of the container when collapsed to thereby substantially fill the interior space and aid in ejecting material from the nozzle. The interconnections are positioned substantially laterally inwardly from a maximum laterally-outward position of the sidewall to correspond approximately to a non-expanded position of the sidewall. The base includes an inwardly directed protrusion thereon having dimensions corresponding to a nozzle interior space and being positioned to be inserted into the nozzle from the interior of the container when the container is fully collapsed. A wall of the base at the interconnections extends almost parallel to an axis of elongation of the collapsed container. A one-way valve can be placed at the nozzle.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
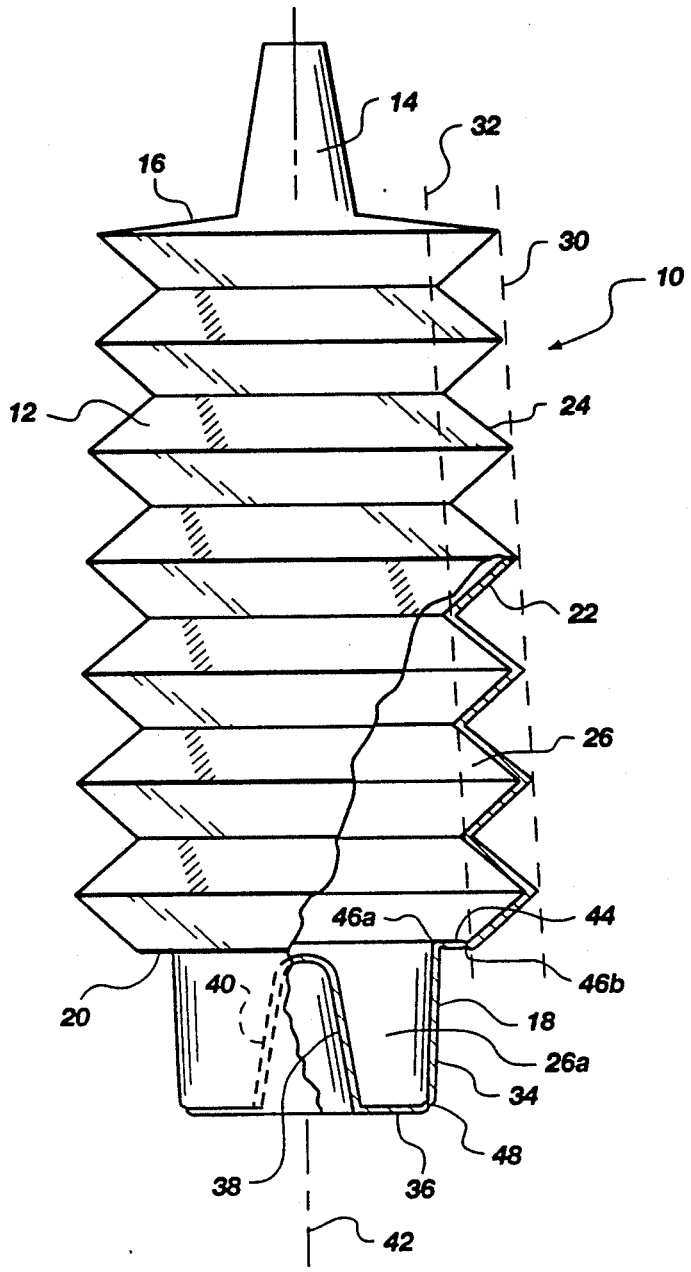
FIG. 1 is a side elevation, partially cutaway, view of a collapsible container of this invention when in an expanded configuration.

A collapsible container, such as a bottle, 10 comprises a collapsible housing 12 which includes a nozzle 14 at a nozzle end 16 thereof, a base 18 at a base end 20 opposite the nozzle end 16 thereof, and a collapsible sidewall 22 interconnecting the nozzle and the base. The sidewall includes accordion-like pleats, or bellows, 24 so that it can be collapsed and expanded to allow the base 18 to move toward and away from the nozzle 14, thereby collapsing and expanding an interior space 26 of the collapsible container 10. In the FIGS. 1 and 2 embodiment the collapsible housing 12 is constructed of a flexible plastic such as polyethylene to form one integrated member.

The pleats 24 of the collapsible sidewall 22 define a maximum laterally-outward position of the sidewall at a dashed line 30 and a minimum laterally-outward position of the sidewall 22 at a dashed line 32. That is, convex, or outward, apexes of the pleats 24 represent the laterally-outward most portion of the collapsible sidewall 22 and concave, or inward, apexes of the pleats 24 define the minimum lateral dimension of the collapsible sidewall. In the depicted embodiment, the collapsible sidewall 22 converges slightly toward the nozzle 14, although this is not necessary to the invention. It will be understood that the maximum and minimum dimension lines 30 and 32 respectively move outwardly and inwardly when the collapsible container 10 is collapsed toward the configuration of FIG. 2, thus, these lines separate from one another with the collapsing of the collapsible container 10.

The base 18 is basically cup-shaped, having a base sidewall 34 and a base bottom wall 36. The base bottom wall includes an inwardly directed protrusion 38 having a contour 40 which is about the same size and shape as a nozzle interior space 28. It should be noticed that the inwardly directed protrusion 38 is aligned with the nozzle interior space 28 along an axis of elongation 42 of the collapsible container 10. The base sidewall 34 is coupled to the collapsible sidewall 22 at the base end 20 by means of an interconnection element 44. In this respect, the interconnection element 44 is somewhat more flexible than the base sidewall 34 and in the depicted embodiment, it includes thin circles 46*a* and *b* to serve as hinge elements. Further, there is a thin ring 48 interconnecting the base sidewall 34 and the base bottom wall 36 which makes this element of the base 18 also more flexible than the rest of the base.

In use, the collapsible container 10 is filled by any conventional means. In this regard, the container 10 can be filled directly or can be collapsed as shown in FIG. 2 while its nozzle 14 is inserted into a powdered or fluid material, such as a medicine, foodstuff, or drug, with which the collapsible container is to be filled. The collapsible container 10 can then be expanded to the configuration shown in FIG. 1 and in doing so a negative pressure is created in the interior space 26 which sucks the material into the interior space. A cap, not shown, is then placed on the nozzle 14 and the charged collapsible container is placed in circulation for use. It should be noted that in this expanded configuration the base 18 is everted, or protrudes outwardly, so that it defines a portion 26*a* of the interior space 26 of the collapsible container 10.

When a user desires to eject the fluid material from the interior space 26, he removes the cap, not shown, and urges the base 18 toward the nozzle 14. The fluid material is thereby ejected from the nozzle 14. Eventually, the collapsible sidewall 22 collapses completely (as is almost shown in FIG. 2) so that its pleats 24 impinge on one another and are almost parallel with one another. It is noted that in the FIG. 2 collapsed embodiment, the pleats are not lying on one another and parallel with one another, however, it is only depicted in this manner for purposes of illustration. It is further noted that the extent to which these pleats collapse can vary considerably. In any event, once the pleats have fully collapsed, the base 18 can be inverted into the interior space 26, as is depicted in FIG. 2, with its wall rotating at the interconnection element 44 and at the interconnection ring 48 so as to achieve the configuration depicted in FIG. 2. In this configuration, the inwardly-directed protrusion 38 extends up into the nozzle interior space 28.

Since the interconnection element 44 is located approximately at the minimum lateral dimension of the collapsible sidewall 22 when it is fully collapsed, the base sidewall 34, when it is inverted, extends along the inner apexes of the pleats 24 and thereby fills the interior space 26 to the maximum, ejecting a maximum amount of material from the interior space 26.

Further, since the base 18 can be either everted, or inverted, it can be used as a container to form a portion of the interior space 26, thereby significantly increasing the volume of the interior space while at the same time it can be inverted for filling the interior space of the collapsed container, and thereby decreasing the volume of the interior space.

By including an inwardly-directed protrusion 38 on the base bottom wall 36, the base 18 also serves to fill the nozzle interior space 28 for ejecting a maximum amount of material from the collapsible container 10 when it is collapsed.

Figure 2:
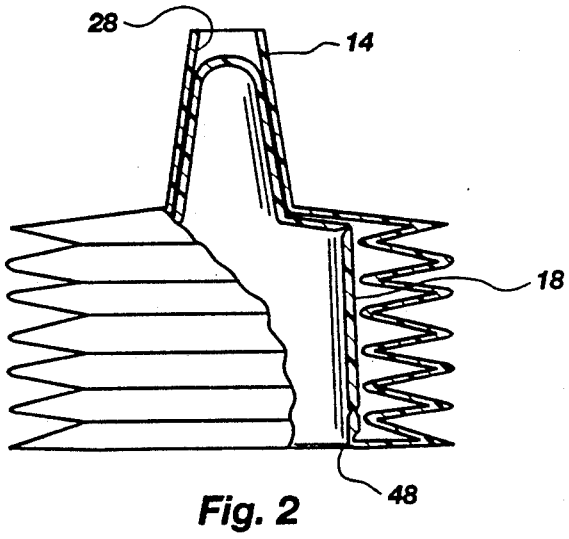
FIG. 2 is a side elevation, partially cutaway, view of a collapsible container of this invention when in a collapsed configuration.

It should be noted that the base sidewall 34 is almost aligned with the axis of elongation 42, although it is on a slight angle thereto, when the collapsible container 10 is in the expanded configuration of FIG. 1. With such a configuration, the base 18 can be snapped between the inverted and everted configurations, which is beneficial.

While the invention has been particularly shown and described with reference to a preferred embodiment, it will be understood by those skilled in the art that various changes in form and detail may be made therein without departing from the spirit and scope of the invention.

For example, although the interconnection elements 44, 46 and 48 are shown as being indention rings, this can be accomplished in other manners. Also, the contours of the various elements can vary to some extent. Moreover, it should be kept in mind that the collapsed embodiment depicted in FIG. 2 is provided for illustrative purposes only and that the pleats of the collapsible sidewall 22 could be much closer together so that more fluid or other material is ejected from the collapsible container 10.

Figure 3:
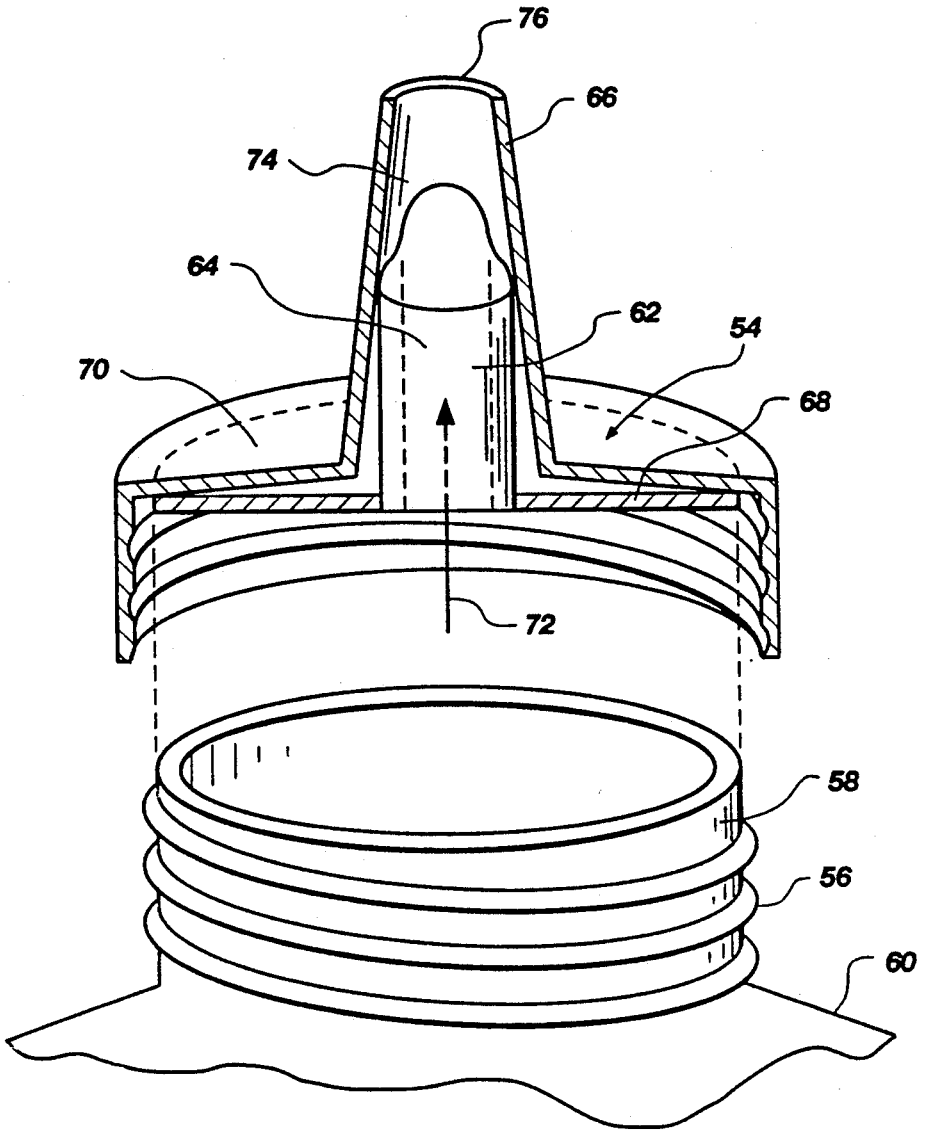
FIG. 3 is a segmented, isometric, cutaway view of a nozzle portion of a second embodiment of this invention.
Figure 4:
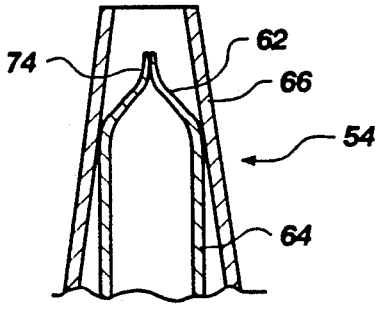
FIG. 4 is a segmented, cross-sectional view of a portion of the FIG. 3 embodiment.

FIGS. 3 and 4 depict another embodiment of this invention in which a nozzle assembly 54 can be screwed to threads 56 on a neck 58 of a collapsible sidewall 60, which is otherwise substantially the same as the structure of the FIG. 1 embodiment. The nozzle assembly 54 has a further feature in that it includes a separate one-way valve, or, more specifically, a duckbill-valve assembly 62 which has a valve nozzle 64 mounted inside a fixed nozzle 66. In this regard, the valve nozzle 64 is held in this position by a disk 68 which is part of the duckbill-valve assembly 62 and which is adhered to or press-fitted onto a plate 70 which is integrally formed with the fixed nozzle 66. The duckbill-valve assembly 62 is basically a one-way valve, allowing fluid or other material to flow in a direction of arrow 72.

The embodiment of FIG. 3 functions substantially the same as the embodiment of FIG. 1 and FIG. 2 with the exception that once material exits through the duckbill-valve assembly 62, the valve assembly closes, not allowing air or other fluids to flow back therein. Thus, when the container is collapsed with its base 18 inverted, as depicted in FIG. 2, it is not allowed to spring back. This provides a continual progressive and incremental reduction in size of the collapsible container as an inner material is used. Also, this prevents an air/material interface which reduces desiccation and/or oxidation of the contained material, thereby preventing wastage and/or spoilage of contained material. In this regard, it should be noted that this one-way valve may be situated in such a way as to form a space 74 between the end of the duckbill-valve assembly 62 and an end 76 of the nozzle 66 whereby this space 74 contains a small residue of inner material ejected from the valve assembly 62, thereby further preventing air or other material from reentering the container through the one-way valve assembly 62 and coming into contact with undispensed material therein. In this embodiment the shape of the inwardly directed protrusion 38 must correspond to a shape of the interior of the valve nozzle 64.

In another embodiment of this invention, the one-way valve can be formed as part of the nozzle 14 itself. That is, the nozzle 14 could be fashioned as a check valve, such as a duckbill valve, or other type of valve. If the one-way valve were integral with the nozzle 14, a separate additional part would not be required.

In still another embodiment of this invention the collapsible sidewall can be constructed with a steadily, progressively increasing wall thickness so that the container will collapse in a predictable fashion. For example, the collapsible sidewall 22 could be thinnest in an upper pleat at the nozzle end 16 and gradually increase to become thickest in a lower-most pleat at the base end 20 so that, when compressed, the upper pleats will fully collapse first, prior to sequential, progressive collapse of the lower pleats. This has the effect of emptying the upper portion of contained material first, which adheres to a "last-in-first-out" concept. Such a structure would be particularly useful for food-stuff containers or containers for other perishable goods.

Also, in one embodiment the sidewalls are fashioned to be opaque, or light-impenetrable.

Figure 5:
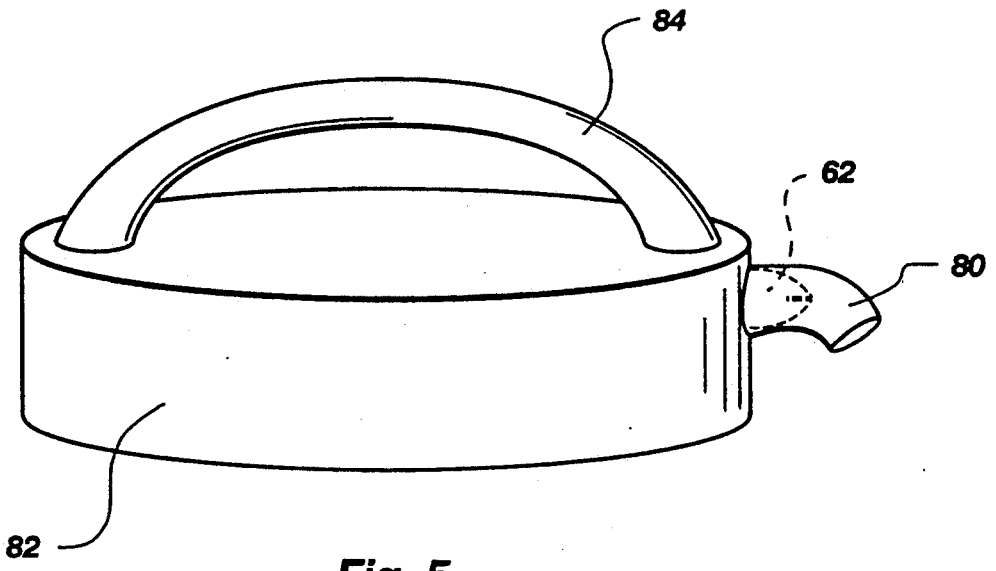
FIG. 5 is an isometric, segmented view of an alternate embodiment.
Figure 6:
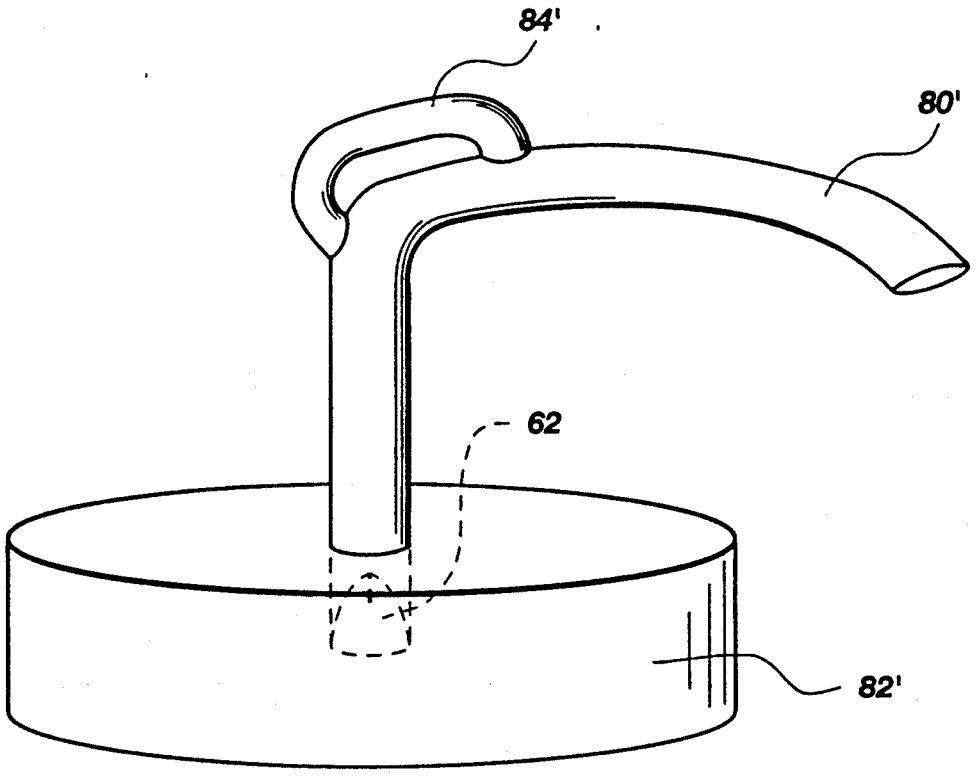
FIG. 6 is an isometric, segmented view of another alternate embodiment.

In yet another embodiment a lateral spout 80 or 80' (FIGS. 5 and 6) formed on a lid 82 or 82' also incorporates a handle portion 84 or 84' for use in dispensing (pressing down on the handle portion 84 or 84' will cause a progressive collapse of the container and this action will force the container material out). Also, the handle portion 84 or 84' will allow the container to be easily carried about by a user, which is important for larger containers, e.g. 5 gallon jugs, for commercial materials. This could also be useful for soap dispensers and other types of household shelf-stored items.

The collapsible container of this invention is extremely beneficially in that it can be substantially completely emptied, thereby making it possible to determine a proper dosage and providing economies in that all material in the container is usable.

It is also extremely valuable that a container of this invention, because of the one-way valve at a nozzle thereof, can be steadily collapsed in incremental amounts at different times without "springing back". This feature prevents the backwashing of ejected material and also protects undispensed container material from contaminating air and proximate debris. In this regard, even containers made of a material for maintaining their collapsed position when fully collapsed into a compressed orientation would derive a benefit from having a one-way valve at a nozzle thereof in situations where it is desirable to achieve full compression for collapsing segments.

It is further beneficial that a container constructed according to the teachings of this invention, by having a one-way valve which prevents backwash, reduces the potential for oxidation, hardening, and/or desiccation of container materials, thereby reducing spoilage and wastage of undispensed container material.

Yet another benefit of the container of this invention is that it has an unincumbered interior space when it is not in a collapsed configuration, whereby it will hold a relatively large amount of material, but yet includes elements which can be collapsed into the interior space for aiding in the ejection of material therefrom.

The collapsible container of this invention is environmentally sensitive in that it is made of a recyclable plastic, it reduces wastage of container material, and the bulk volume of the empty container is reduced.

The embodiments of the invention in which an exclusive property or privilege are claimed and defined as follows:

1. A collapsible container comprising:

a collapsible housing including a nozzle means at a nozzle end of said container for allowing material in an interior space of said container to exit said container therethrough;

a base means at a base end of said container, opposite said nozzle end, for forming a container portion of the interior space of the container for containing said material therein; and a collapsible sidewall interconnecting said nozzle and said base means collapsing and expanding to allow the base means to move toward and away from said nozzle means, thereby collapsing and expanding the interior space of the container, said sidewall comprising a progressively increasing thickness;

wherein said collapsible housing includes interconnection means for coupling said base means to said sidewall for allowing said base means to protrude outwardly to thereby significantly increase the volume of the interior space of said collapsible container, but for also allowing said base means to protrude inwardly, into the interior space of said collapsible container when said collapsible container is collapsed, to thereby decrease the volume of the interior space, said base means having a shape and size substantially corresponding to that of the collapsed interior space of said collapsible container when it is collapsed to thereby substantially fill said collapsed interior space and aid in ejecting fluid material from said collapsed interior space through said nozzle.

2. A manually collapsible container comprising:

a pleated bellows section comprising a plurality of stacked pleated bellows segments, the pleated bellows section having an extended position defining a predetermined interior volume and a collapsed position comprising a predetermined collapsed longitudinal distance;

a top nozzle section comprising a hollow discharge nozzle;

a two position manually invertible non-pleated bottom section comprising an annular sidewall extending downwardly beyond the bellows section, a transversely disposed disc-shaped bottom wall and an upwardly directed male projection disposed in alignment with and sized and shaped to selectively extend into the hollow discharge nozzle;

one of said non-pleated bottom section positions comprising a position extending longitudinally beyond the pleated bellows section, the non-pleated bottom section defining a second but non-pleated storage cavity in addition to the pleated volume of the pleated bellows section, the second non-pleated storage cavity being disposed between the annular sidewall, the disc-shaped bottom wall and the male projection;

The other of said non-pleated bottom section positions comprising a manually longitudinally inverted inwardly-extending position disposed within the pleated bellows section whereby the second storage cavity is eliminated due to inversion and whereby the male projection becomes positioned within the hollow discharge nozzle when the bellows section is in its collapsed position.

3. A manually collapsible container according to claim 2 wherein the collective length of the annular sidewall and the bottom wall is substantially the same as said collapsed longitudinal distance of the bellows section in the collapsed position.

4. A manually collapsible container according to claim 2 wherein a first annular hinge is disposed between the bottom wall and the annular sidewall and a second annular hinge is disposed between the annular sidewall and the bellows section.

5. A manually collapsible container according to claim 4 wherein a third hinge is disposed within the bellows section directly juxtaposed the annular sidewall by which the effective diameter of the inverted bottom section is enlarged to be substantially the same as the interior diameter of the bellows section.

6. A manually collapsible container according to claim 2 wherein the bellows section comprises an interior diameter slightly greater than the diameter of the annular sidewall.

7. A manually collapsible container according to claim 2 further comprising a one-way valve disposed within the hollow discharge nozzle which prevents return of the bellows section from a collapsed or partially collapsed condition to its expanded position.

8. A manually collapsible container according to claim 7 wherein the one-way valve comprises a duckbill valve.

9. A manually collapsible container according to claim 2 further comprising a handle associated with the nozzle section for manual manipulation of the collapsible container.

* * * * *